US007042692B2

(12) United States Patent
Ueki et al.

(10) Patent No.: US 7,042,692 B2
(45) Date of Patent: May 9, 2006

(54) ELECTROMAGNETIC APPARATUS DRIVE APPARATUS

(75) Inventors: Koichi Ueki, Tokyo (JP); Kimitada Ishikawa, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/499,445

(22) PCT Filed: Dec. 25, 2002

(86) PCT No.: PCT/JP02/13475

§ 371 (c)(1),
(2), (4) Date: Jul. 29, 2004

(87) PCT Pub. No.: WO03/056581

PCT Pub. Date: Jul. 10, 2003

(65) Prior Publication Data

US 2005/0047052 A1 Mar. 3, 2005

(30) Foreign Application Priority Data

Dec. 26, 2001 (JP) ..... 2001-394544

(51) Int. Cl.
*H01H 47/00* (2006.01)

(52) U.S. Cl. ..... 361/143; 361/152; 361/153

(58) Field of Classification Search ..... 361/153, 361/152, 143

See application file for complete search history.

(56) References Cited

U.S. PATENT DOCUMENTS 4,729,056 A * 3/1988 Edwards et al. ..... 361/153

FOREIGN PATENT DOCUMENTS

| | | |
|---|---|---|
| JP | H3-20406 | 2/1991 |
| JP | H3-283606 | 12/1991 |
| JP | H5-284737 | 10/1993 |
| JP | H6-61043 | 3/1994 |
| JP | 2626147 | 4/1997 |
| JP | 2001-275342 | 10/2001 |

* cited by examiner

*Primary Examiner*—Phuong T. Vu
*Assistant Examiner*—Ann T. Hoang
(74) *Attorney, Agent, or Firm*—Manabu Kanesaka

(57) ABSTRACT

Conventionally, a non-conductive period is provided in a region in the vicinity of zero of an AC power voltage via a voltage detection circuit 14 to turn off reliably. The FET 17 maintains the ON state within several switching cycles after the non-conductive interval to rapidly restore the magnetizing coil current, so that the magnetizing coil current rapidly increases. An object is to suppress beat noise in the electromagnetic device. Within a prescribed interval following the non-conductive interval, a partial voltage at a resistor 19 of an output V2 of a mono-stable circuit 20 is added as a bias voltage to a detection voltage of a magnetizing coil current at a resistor 18, and is detected by the IC 11. The IC 11 drives a FET 17 with a constant switching period after the non-conductive interval, thereby preventing the increase in the magnetizing coil current and resolving the problem.

9 Claims, 10 Drawing Sheets

ELECTROMAGNETIC APPARATUS DRIVE APPARATUS

TECHNICAL FIELD

The present invention relates to a drive unit for an electromagnetic device, in which a drive current for energizing a magnetizing coil of an electromagnetic device is controlled with constant-current control through switching means for switching power source to reduce power consumption of the electromagnetic device. In particular, the present invention relates to a drive unit for an electromagnetic device in which noise generated from the electromagnetic device due to an operation of the switching means is reduced.

BACKGROUND OF THE INVENTION

Switching means switches an electric current supplied to a magnetizing coil of an electromagnetic device to reduce power consumption of the electromagnetic device as disclosed in Japanese Patent No. 2626147. In the disclosed technology, a switching control circuit drives power distribution to a magnetizing coil of an electromagnetic device according to an intermittent pulse signal. A main switching element of a contact-less relay inserted between the magnetizing coil of the electromagnetic device and an AC power source is switched to close and release the electromagnetic device. The main switching element in the contact-less relay becomes a non-conductive state in a region in the vicinity of zero of the power source voltage below a self-holding current for a predetermined period of time longer than a cycle of the intermittent pulse signal output from the switching control circuit. Accordingly, even if an OFF command is sent to the contact-less relay, an AC path of the contact-less relay maintains a conductive state, so that the electromagnetic device can be released.

FIG. 4 is a view showing a circuit diagram of a conventional drive unit for an electromagnetic device in which power consumption of the electromagnetic device is further reduced through constant-current control of a magnetizing current of the electromagnetic device, similar to the technology described above. FIG. 5 is a view showing a basic inner structure of a current mode PWM control IC 11 shown in FIG. 4. FIG. 9 shows operational waveforms of main components shown in FIG. 4, and FIG. 10 shows an operational waveform of a voltage detection circuit 14 shown in FIG. 4.

In FIG. 4, reference numeral 4 denotes a magnetizing coil (MC) of an electromagnetic device such as an electromagnetic contactor connected to a DC output side of a diode bridge 2, and reference numeral 1 denotes a contact-less relay for switching the AC power source to the diode bridge (SSR; Solid State Relay) In this circuit diagram, the contact-less relay 1 is switched to close and release the electromagnetic device. Input terminals T1 and T2 are connected to an AC power source. Output terminals T3 and T4 of the contact-less relay 1 are connected in series to the input terminals T1 and T2. A DC power source E is connected to the input terminals T5 and T6 of the contact-less relay 1 via a switch SW0 and a light-emitting diode PD of a phototriac coupler PC.

A main triac TR is connected parallel to the phototriac PTr of the phototriac coupler PC, and a resistor R11 is connected between a gate of the main triac TR and one terminal thereof. A snubber circuit formed of a capacitor C10 and a resistor R10 is connected in parallel to the main triac TR.

The diode bridge 2 is connected between the output terminal T2 of the contact-less relay 1 and the input terminal T2 of the AC power source. A series circuit formed of the magnetizing coil (MC) of the electromagnetic device, a power MOSFET 17 as a main switching element for controlling a current Imc of the magnetizing coil 4, and a current detection resistor 18 (resistance value of R18) inserted into a source side of the MOSFET 17 for detecting the current Imc of the magnetizing coil 4 is connected to a DC output terminal of the diode bridge 2. A capacitor 3 is connected in parallel to the series circuit, and a flywheel diode 5 is connected in parallel to the magnetizing coil 4.

A series circuit formed of a resistor 6 and a Zener diode 9 is connected to the DC output terminal of the diode bridge 2, and a series circuit formed of a resistor 7, a transistor 8 with a base connected to a contact point between the resistor 6 and Zener diode 9, and a capacitor 10 is also connected to the DC output terminal of the diode bridge 2. The circuits constitute a power source circuit for generating a constant voltage supplied to a power source terminal VIN of the current mode PWM control IC 11. PWM stands for Pulse Width Modulation.

A series circuit formed of voltage-dividing resistors 12 and 13 is connected to the DC output terminal of the diode bridge 2. A voltage 14*a* at a contact point between the resistors 12 and 13 is inputted into a voltage detection circuit 14 for detecting that a voltage of the AC power source reaches the vicinity of zero. A voltage between the DC output terminals of the diode bridge 2 appears as a double rectified voltage of the AC power source, and is divided with the voltage-dividing resistors 12 and 13 to obtain the voltage 14*a*. As shown in FIG. 10, the voltage detection circuit 14 outputs a voltage V1 at a H level at an interval t1 when the voltage 14*a* becomes below a predetermined low voltage detection level VL0, and outputs the voltage V1 at a L level outside the interval t1 to be supplied to a feedback input terminal FB of the current mode PWM control IC 11.

The low voltage detection level VL0 is set such that the interval t1 becomes longer than an output cycle T of the PWM pulse Vout (described later). The capacitor C3 provided between the DC output terminals of the diode bridge 2 serves as a power source with respect to a high-frequency component in the load current on the DC side of the diode bridge 2. Due to a small capacitance of the capacitor, a voltage waveform between the DC output terminals of the diode bridge 2 becomes double rectified voltage waveform following a change in the AC power source voltage.

A PWM control pulse (PWM pulse) Vout is outputted from the OUT terminal of the current mode PWM control IC 11, and is inputted into the gate of the power MOSFET 17. A current detection voltage Vcs (=(resistance value R18 of the resistor 18)×(current Imc of the magnetizing coil 4)) is generated at both ends of the current detection resistor 18, and is inputted into the current detection terminal CS of the current mode PWM control IC 11 via the resistor 19.

Reference numerals 15 and 16 denote a timing resistor and a timing capacitor for determining the cycle of the PWM pulse of the current mode PWM control IC 11. The timing resistor 15 is connected between an output terminal Vref of the IC 11 having a reference voltage (in the present example, 5 V) and a timing resistance/capacitance connection terminal RT/CT. The timing capacitor 16 is connected between the terminal RT/CT of the IC 11 and a negative-side terminal of the diode bridge 2. A ground terminal GND of the IC 11 (see FIG. 5) is connected to the negative-side terminal of the diode bridge 2.

In this case, the current mode PWM control IC for switching the power source performs the constant voltage control of the switching powder source voltage, while controlling the load current thereof, is used as the current mode PWM control IC 11. In the present example, the IC performs the constant current control when the load of the switching power source becomes large, more specifically, when an error amplifier output voltage Vcomp (described later) exceeds a prescribed value.

A function of the current mode PWM control IC 11 related to the constant current control will be explained next with reference to FIGS. 4, 5 and 9. As shown in FIG. 5, when a voltage supplied to the power source terminal VIN of IC 11 becomes a normal operation mode voltage (in the present example, 16 V) of the IC 11, a lock of the low-voltage lock-out circuit UVL1 is released to turn on a 5 V band gap reference voltage regulator REG. Accordingly, the reference voltage Vref of 5 V is generated from the voltage supplied to the power source terminal VIN, and is outputted to the terminal Vref of the IC 11 and other components located in the IC 11 as necessary.

When the regulator REG outputs the reference voltage Vref greater than 4.7 V, a lock of another low-voltage lock-out circuit UVL2 is released. Also, an output of an OR circuit G2, i.e. one of inputs of a NOR circuit G1, becomes "L", thereby releasing one of conditions for stopping an output of the PWM pulses Vout from a totem pole output circuit TTP driven by an NOR circuit G1. Conversely, before the release, at least the output of the PWM pulse Vout is stopped and the power MOSFET 17 using the PWM pulse Vout as a gate input is maintained in an OFF state.

An oscillator OSC generates a triangular wave W1 for determining an output cycle T of the PWM pulse Vout. That is, when an output of a comparator CP1 constituting the oscillator OSC is "L", semiconductor switches SW1 and SW2 also constituting the oscillator OSC are OFF, and a voltage of 2.8 V as an upper limit voltage of the triangular wave W1 is inputted in an (−) input terminal of the comparator CP1. The timing capacitor 16 is charged with the reference voltage Vref via the timing resistor 15. The charge voltage of the timing capacitor 16 is inputted into an (+) input terminal of the comparator CP1 via the timing resistance/capacitance connection terminal RT/CT of the IC 11.

When the charge voltage of the timing capacitor 16 is about to exceed 2.8 V, the output of the comparator CP1 is changed to "H". As a result, the semiconductor switches SW1 and SW2 are turned ON, and the voltage of the (−) input terminal of the comparator CP1 is switched to 1.2 V, i.e. a lower limit voltage of the triangular wave W1. Also, the constant current source IS1 is connected to the terminal RT/CT of the IC 11, and the timing capacitor 16 starts discharging.

When the voltage of the timing capacitor 16 is about to become below 1.2 V, the output of the comparator CP 1 is changed to "L", and the voltage of the timing capacitor 16 increases, thereby generating the continuous triangular wave W1.

At this time, the comparator CP 1 outputs an oscillation output W2 composed of a square pulse. The oscillation output W2 is inputted into a latch set pulse generation circuit LS. The pulse generation circuit LS generates a latch set pulse P1 each time the oscillation output W2 rises, and supplies the pulse to a NOR circuit G1 and a set input terminal S of a current detection latch FF composed of an RS flip-flop.

When the latch set pulse P1 is inputted, an inverted output QB (B standing for bar) of the current detection latch FF becomes "L" and a total input of the NOR circuit G1 becomes "L". Accordingly, an output of the totem pole output circuit TTP, i.e. the PWM pulse Vout outputted from the OUT terminal of the IC 11, becomes the H level to turn on the external power MOSFET 17. The PWM pulse Vout maintains at the H level, i.e. the power MOSFET 17 turned on, until the current detection latch FF is reset and the inverted output QB thereof becomes "H". A reset signal to the input terminal resistor of the current detection latch FF is supplied as the output of the CS comparator CP2. The output of the comparator CP2 is generated when the power MOSFET 17 is turned on and the voltage Vcs of the current detection terminal CS, i.e. the voltage of the (+) input terminal of the CS comparator CP2, gradually increases and exceeds the voltage Vcsn at the (−) input terminal of the CS comparator CP2.

As shown in FIG. 4, in the voltage detection circuit 14, the voltage V1 applied to the feedback input terminal FB of the IC 11 only at the interval t1 in the vicinity of the zero of the AC power source voltage, i.e. the voltage of (−) input terminal of the error amplifier EA, is the H level, and is the L level at an outside of the interval t1. In the present example, the H level of the voltage V1 is higher than the voltage (2.5 V) of the (+) input terminal of the error amplifier EA, and the L level of voltage V1 is almost 0 V.

Therefore, at the interval t1, an output voltage (error voltage) Vcomp of an error amplifier EA is at least 1.4 V or less, and the (−) input terminal voltage Vcsn of the CS comparator is almost 0 V. At an outside of the interval t1, the error voltage Vcomp is at least 4.4 V or more, and the (−) input terminal voltage Vcsn of the CS comparator is fixed to 1 V of the Zener voltage as the upper limit value. Accordingly, at an outside of the interval t1, the magnetizing coil current Imc increases after the power MOSFET 17 is turned on. As a result, the voltage of the current detection resistor 18, i.e. the voltage ("CS terminal voltage") Vcs of the current detection terminal CS of the IC 11, gradually increases and reaches 1 V of the (−) input terminal voltage Vcsn of the CS comparator, so that the CS comparator CP2 executes an operation of resetting the current detection latch FF.

A time interval from setting to resetting of the current detection latch FF corresponds to a pulse width (interval of H level) of the PWM pulse Vout, i.e. an ON interval of the power MOSFET 17. The time interval becomes longer when the current Imc of the magnetizing coil 4 at an initial stage of the ON interval is small, and becomes shorter as the magnetizing coil current Imc increases and approaches the set value (corresponding to 1 V of the (−) input terminal voltage Vcsn of the CS comparator). The constant current control by the PWM control of the current Imc of the magnetizing coil 4 is performed as described above.

On the other hand, at the interval t1, the (−) input terminal voltage Vcsn of the CS comparator becomes zero. Therefore, the pulse width of the PWM pulse Vout, i.e. the ON interval of the power MOSFET 17, becomes 0 due to the operations shown in FIG. 5. In an actual case, the pulse width enters a non-sensitivity zone, so that the PWM pulse Vout is not outputted and the power MOSFET 17 remains off.

An operation of the entire configuration shown in FIG. 4 will be explained with reference to FIG. 9. When the AC power source is connected to the input terminals T1 and T2 of the AC power source and a switch SW0 provided between the input terminals T5 and T6 of the contact-less relay 1 is turned on, the phototriac coupler PC of the contact-less relay 1 is turned on. As a result, a current flows to the gate of the main triac TR to turn on the main triac TR, and an AC input voltage is applied to the diode bridge 2. The capacitor 10 is charged via the transistor 8 until the voltage fully rectified by the diode bridge 2 exceeds the Zener voltage of the Zener diode 9. When the fully rectified voltage of the diode bridge 2 exceeds the Zener voltage of the Zener diode 9, the capacitor 10 accumulates an electric charge corresponding to the Zener voltage of the Zener, thereby obtaining the constant voltage.

The voltage of the capacitor 10 is inputted to the power source terminal VIN of the current mode PWM control IC 11 to start a normal operation of the IC 11. During the time when the output voltage V1 of the voltage detection circuit 14, i.e. the voltage of the feedback input terminal FB of the IC 11, is at the L level, the current Imc of the magnetizing coil 4 is controlled with the constant current control through the switching in the PWM control of the power MOSFET 17 according to the operation of the IC 11 described above.

That is, the PWM pulse Vout of the H level is outputted and the power MOSFET 17 is switched on for each period T in which the latch set pulse P1 in the IC 11 is outputted. Accordingly, the fully rectified voltage of the diode bridge is applied to the magnetizing coil 4 via the current detection resistor 18, and the current Imc of the magnetizing coil 4 increases. At this time, a slope of the magnetizing coil current Imc is mainly determined by an inductance of the magnetizing coil 4 and an instantaneous value of the fully rectified voltage. When the voltage (R18×Imc) of the current detection resistor 18, i.e. the CS terminal voltage Vcs of the IC 11, reaches 1 V of the (−) input terminal voltage Vcsn of the CS comparator of the IC 11 with the increase in the magnetizing coil current Imc, the PWM pulse Vout becomes the L level. Also, the power MOSFET 17 is turned off, and the current Imc of the magnetizing coil 4 flows to the flywheel diode 5, and is attenuated while circulating in the magnetizing coil 4 and diode 5. A time constant of the current attenuation is determined by an impedance of the magnetizing coil 4 and a resistance of the circulation flow path.

When the power MOSFET 17 is turned on, the magnetizing coil current Imc is again switched to rising. In such an operation, immediately after the switch SW0 of the contact-less relay 1 is turned on, the magnetizing coil current Imc is not established within one output cycle T of the latch set pulse P1. Accordingly, the voltage of the current detection resistor 18, i.e. the CS terminal voltage Vcs of the IC 11, does not reach 1 V. As a result, as shown by an enlarged portion of time axis in FIG. 9, the current detection latch FF in the IC 11 is not reset, and the power MOSFET 17 substantially maintains the ON state.

The magnetizing coil current Imc is established and the CS terminal voltage Vcs reaches 1 V after several output cycles T of the latch set pulse P1 pass (point of time τc shown in FIG. 9). Then, the ON/OFF operation of the power MOSFET 17 per each period T is executed and the magnetizing coil current Imc is maintained at an almost constant value, thereby reducing power consumption in the magnetizing coil 4. Accordingly, when the magnetizing coil current Imc is established, the electromagnetic device, i.e. the electromagnetic switch in the present example, is closed.

In the interval t1 where the AC power source voltage is close to zero, the power MOSFET 17 is held in the OFF state as described above. The interval t1 is selected to be larger than the ON/OFF period T of the power MOSFET 17 and the turn-off time interval of the main triac TR of the contact-less relay 1. If the input switch SW0 of the contact-less relay 1 remains closed, the attenuation of the magnetizing coil current Imc within the interval t1 is comparatively large, as shown in FIG. 9. The main triac TR of the contact-less relay 1 is conductive again after the interval t1, so that the ON/OFF operation of the power MOSFET 17 per each period T is performed via the ON interval tr of the power MOSFET 17 containing several periods T.

On the other hand, when the input switch SW0 of the contact less relay 1 is opened, the main triac TR of the contact-less relay 1 is turned off within the first interval t1 after the opening. The rectified output voltage of the diode bridge 2 disappears, and the current Imc of the magnetizing coil 4 is attenuated while being commuted to the flywheel diode 5, and disappears. The release of the electromagnetic device is carried out during this attenuation.

At the initial point of time of the electromagnetic device closing and in the holding interval of the electromagnetic device after closing, the configuration actually allows the value of the current detection resistor 18 to be changed with means which is not shown in the figure. In the holding interval of the electromagnetic device, the magnetizing coil current Imc is made smaller than that at the initial point of time of closing, thereby reducing power consumption. The waveform in FIG. 9 shows an example at the holding time of the electromagnetic device.

Strictly speaking, in a section indicated by a projected line in the enlarged portion of time axis (interval tr) of the CS terminal voltage Vcs shown in FIG. 9, i.e. a very small interval in which the latch set pulse P1 is present, the output of the NOR circuit G1 in the IC 11 becomes "L" and the PWM pulse Vout is at the L level. The power MOSFET 17 is instantaneously driven OFF, and is maintained in the ON state due to a turn-off delay of the power MOSFET 17.

The device shown in FIG. 4 has the following problems. That is, as shown in FIG. 9, within the holding interval of the electromagnetic device, when the main triac TR of the contact-less relay 1 is transited from the non-conductive interval to the conductive interval as the interval t1 sandwiching the zero cross point of the AC power source voltage, the current Imc of the magnetizing coil 4 becomes substantially lower than the set value in the non-conductive interval t1. Accordingly, the current mode PWM control IC 11 outputs the PWM pulse Vout in a substantially ON mode within the interval tr significantly longer than the usual switching period T. When the magnetizing coil current Imc reaches the set current (holding current of the electromagnetic device), that is, when the CS terminal voltage Vcs reaches 1 V of the (−) input terminal voltage Vcsn of the CS converter, the PWM pulse Vout is turned off.

A variation in the magnetizing coil current Imc in the interval tr (also referred to herein below as the continuous ON interval of the PWM pulse Vout or power MOSFET 17) is greater by about an order of magnitude than the variation in the current of the current pulsation component stabilized after the interval. As a result, the attraction force of the electromagnetic device is greatly fluctuated, thereby causing beat sound from the electromagnetic device.

SUMMARY OF THE INVENTION

An object of the present invention is to provide a drive unit for an electromagnetic device capable of reliably releasing an electromagnetic device with a non-conductive interval t1. It is possible to reduce power consumption through constant current control conducted with PWM control of a magnetizing coil current of the electromagnetic device, and also to reduce beat noise of the electromagnetic device in a holding state.

In order to solve the problems described above, according to a first aspect of the present invention, a drive unit of an electromagnetic device includes a switching control circuit (current mode PWM control IC 11) for driving a current to a magnetizing coil of the electromagnetic device according to an intermittent pulse signal (PWM pulse Vout) via switching means (power MOSFET 17). The switching control circuit switches the pulse signal so that the switching means is switched from an OFF state to an ON state at a first timing of turn-on timings generated in a predetermined period (T). The switching control circuit also switches the pulse signal so that the switching means is switched to the OFF state at a timing in which a detected value (CS terminal voltage Vcs) of the electric current of the magnetizing coil becomes a predetermined value ((−)input terminal voltage Vcsn of the CS comparator CP2, 1 V in an embodiment). The drive unit closes and releases the electromagnetic device by switching a main switching element (main triac) of a contact-less relay (1) inserted between the magnetizing coil of the electromagnetic device and an AC power source. The main switching element in the contact-less relay becomes a non-conductive state for a predetermined period of time longer than the predetermined period (via the voltage detection circuit 14) in a region (interval t1) in the vicinity of zero of a power source voltage below a self-holding current. A predetermined bias signal is superimposed on the current detection value or current set value at least within a predetermined interval (t2) following the time interval of the non-conductive state. The switching control circuit switches the pulse signal so as to switch the switching means per each predetermined period.

According to a second aspect of the present invention, in the drive unit for the electromagnetic device in the first aspect, the bias signal is a continuous signal (divided value (voltage of a resistance 19) of an output voltage V2 of a mono-stable circuit) at a predetermined level (via the mono-stable circuit 20 and the like).

According to a third aspect of the present invention, in the drive unit for the electromagnetic device in the first aspect, the bias signal is a signal (divided value (voltage of the resistance 19) of an output voltage V3 of an AND circuit) at a predetermined level present only when the switching means becomes the ON state (via the mono-stable circuit 20, AND circuit 23, or the like).

According to a fourth aspect of the present invention, in the drive unit for the electromagnetic device in the third aspect, the pulse signal for causing the switching means to become the ON state (via the resistor 22 or the like) is used for the bias signal.

According to a fifth aspect of the present invention, in the drive unit for the electromagnetic device in the first aspect, the bias signal is a signal of a predetermined waveform having a level decreasing with time.

An effect of the present invention is as follows. The drive unit closes and releases the electromagnetic device by switching the main switching element of the contact-less relay inserted between the AC power source and the magnetizing coil of the electromagnetic device controlled with the constant-current control by switching the switching means (power MOSFET 17) with the PWM control according to the synchronization signal (latch set pulse P1) in the prescribed period (T). In order to maintain the main switching element of the contact-less relay in a conductive state so that the electromagnetic device can be released even if an OFF command is supplied to the contact-less relay, the predetermined bias signal is superimposed on the current detection value or current set value at least within the predetermined interval (t2) following the non-conductive interval (t1) provided in the region in the vicinity of zero of the AC power source voltage. As a result, the switching means, within the period corresponding to the predetermined period (T) in the ON state, apparently is switched to the OFF state in which the current in the magnetizing coil reaches the set value. The switching means is switched per the predetermined period (T) immediately after a non-conductive period, thereby gradually increasing the current in the magnetizing coil to the set value.

DESCRIPTION OF REFERENCE NUMERALS AND SYMBOLS

1: CONTACT-LESS RELAY (SSR), SW0: INPUT SWITCH OF CONTACTLESS RELAY, PC: PHOTOTRIAC OF CONTACTLESS RELAY, TR: MAIN TRIAC OF CONTACTLESS RELAY, 2: DIODE BRIDGE, 3: CAPACITOR, 4: MAGNETIZING COIL (MC) OF ELECTROMAGNETIC DEVICE, Imc: ELECTRIC CURRENT OF MAGNETIZING COIL 4, 5: FLYWHEEL DIODE, 6 and 7: RESISTORS, 8: TRANSISTOR, 9: ZENER DIODE, 10: CAPACITOR, 11: CURRENT PWM CONTROL IC, 12 and 13: VOLTAGE-DIVIDING RESISTORS, 14: VOLTAGE DETECTION CIRCUIT, 14: INPUT VOLTAGE OF VOLTAGE DETECTION CIRCUIT 14, V1: OUTPUT VOLTAGE OF VOLTAGE DETECTION CIRCUIT 14, 15: TIMING RESISTOR, 16: TIMING CAPACITOR, 17: POWER MOSFET, 18: CURRENT DETECTION RESISTOR, R18: RESISTANCE VALUE OF CURRENT DETECTION RESISTOR 18, 19: VOLTAGE-DIVIDING RESISTOR, 20: MONOSTABLE CIRCUIT, V2: OUTPUT VOLTAGE OF MONOSTABLE CIRCUIT, 21 and 22: VOLTAGE-DIVIDING RESISTORS, 23: AND CIRCUIT, V3: OUTPUT VOLTAGE OF AND CIRCUIT 23, CS: CURRENT DETECTION TERMINAL CS OF IC 11, Vcs: NPUT VOLTAGE OF CURRENT DETECTION TERMINAL CS OF IC 11,=((+) INPUT TERMINAL VOLTAGE OF CS COMPARATOR IN IC 11), FB: FEEDBACK INPUT TERMINAL OF IC 11, RT/CT: TIMING RESISTANCE/CAPACITANCE CONNECTION TERMINAL OF IC 11, Vref: REFERENCE VOLTAGE OUTPUT TERMINAL OF IC 11, VIN: POWER SOURCE TERMI- NAL OF IC 11, OUT: PWM PULSE OUTPUT TERMINAL OF IC 11, Vout: PWM PULSE, EA: ERROR AMPLIFIER IN IC 11, Vcomp: OUTPUT (ERROR VOLTAGE) OF ERROR AMPLIFIER, OSC: OSCILLATOR IN IC 11, LS: LATCH SET PULSE GENERATION CIRCUIT IN IC 11, P1: LATCH SET PULSE, CP2: CS COMPARATOR IN IC 11, Vcsn: (−) INPUT TERMINAL VOLTAGE OF CS COMPARATOR, FF: CURRENT DETECTION LATCH IN IC 11, G1: NOR CIRCUIT IN IC 11, TTP: TOTEM POOLE OUTPUT CIRCUIT IN IC 11

DETAILED DESCRIPTION OF PREFERRED EMBODIMENTS

[First Embodiment]

Figure 1:
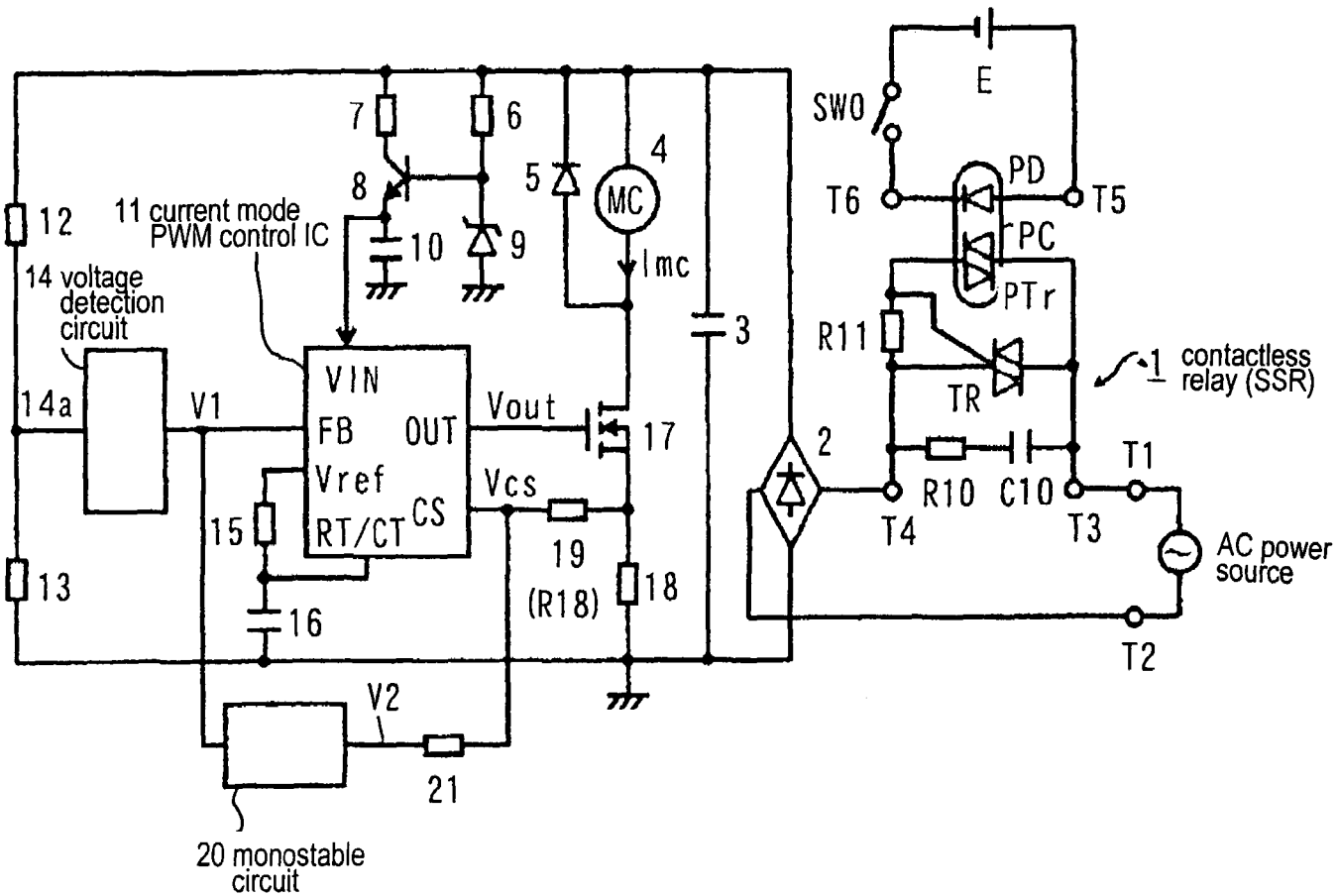
FIG. 1 is a circuit diagram illustrating a configuration according to a first embodiment of the present invention.
Figure 6:
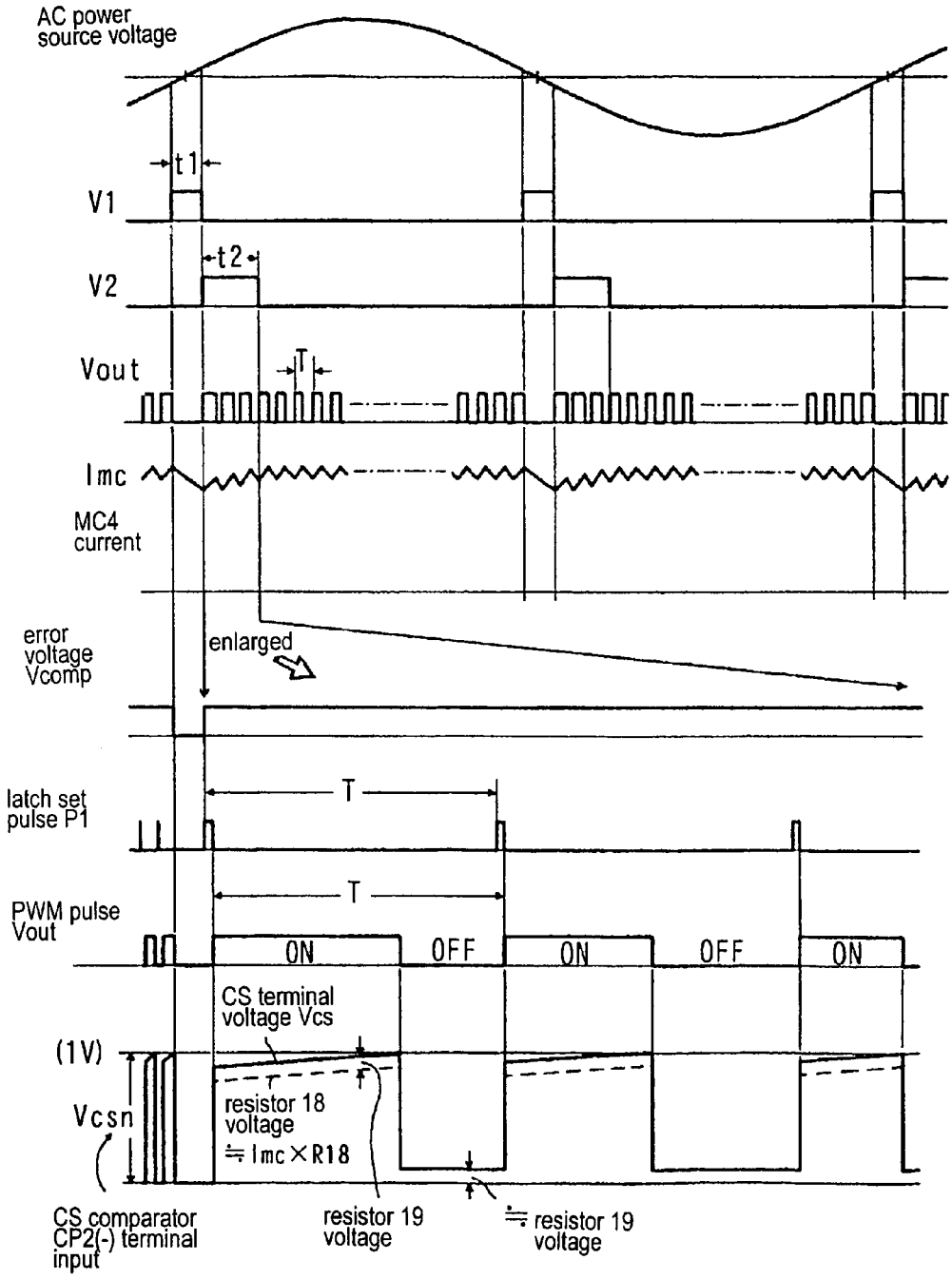
FIG. 6 is a waveform diagram illustrating an operation of main components shown in FIG. 1.

FIG. 1 shows a circuit diagram of a drive device for an electromagnetic device according to a first embodiment of the present invention. FIG. 6 shows an operational waveform of a main part of the circuit shown in FIG. 1 when the electromagnetic device becomes a hold state. Here, FIG. 1 corresponds to FIG. 4, and FIG. 6 corresponds to FIG. 9.

Figure 4:
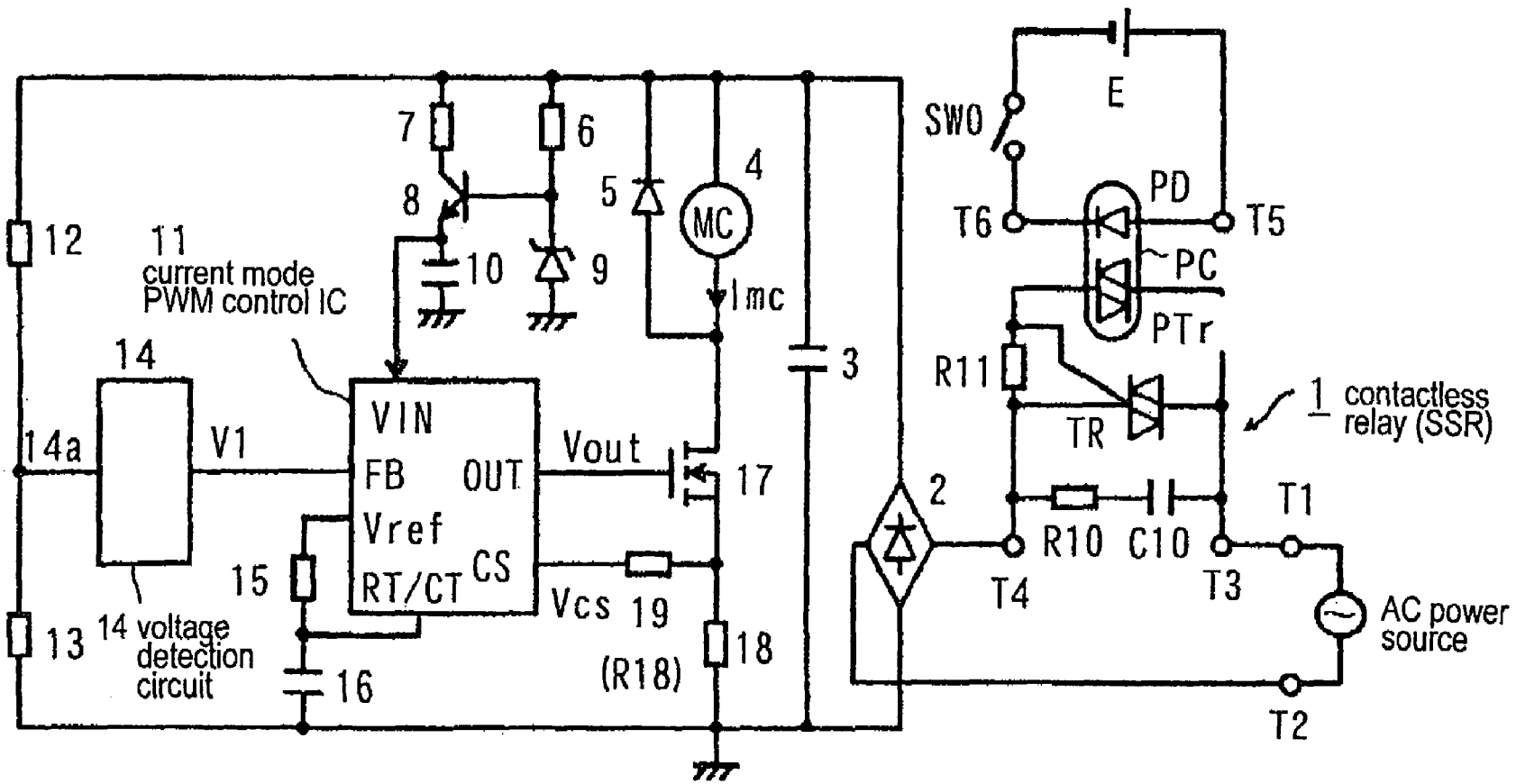
Fig. 4 Prior Art
FIG. 4 is a conventional circuit diagram corresponding to FIGS. 1 to 3.
Figure 5:
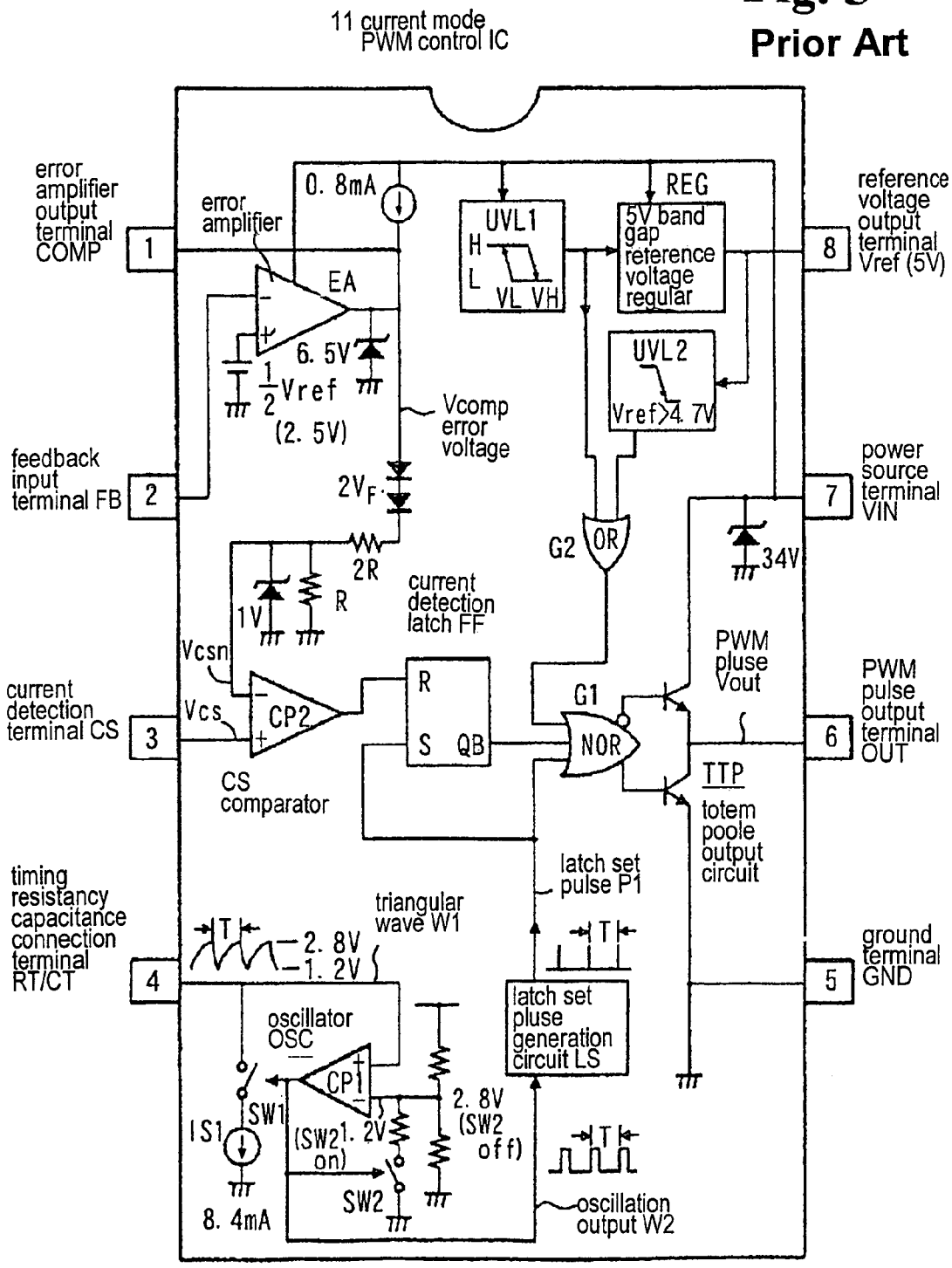
Fig. 5 Prior Art
FIG. 5 is a circuit diagram illustrating a configuration of an inner part of a current mode PWM control IC 11 shown in FIGS. 1 to 4.

The circuit diagram shown in FIG. 1, in addition to the components shown in FIG. 4, comprises a mono-stable circuit 20 and a resistor 21 connected between an output terminal of the mono-stable circuit 20 and a current detection terminal CS of a current mode PWM control IC 11. As shown in FIG. 6, the mono-stable circuit 20 is triggered when a voltage V1 of an H level outputted by a voltage detection circuit 14 decreases within a non-conductive interval t1 centered around a 0 cross point with the AC power source voltage. A voltage V2 of the H level is outputted within a period t2 comprising a plurality of periods T of a latch set pulse P1 after the voltage V1 decreases.

Figure 9:
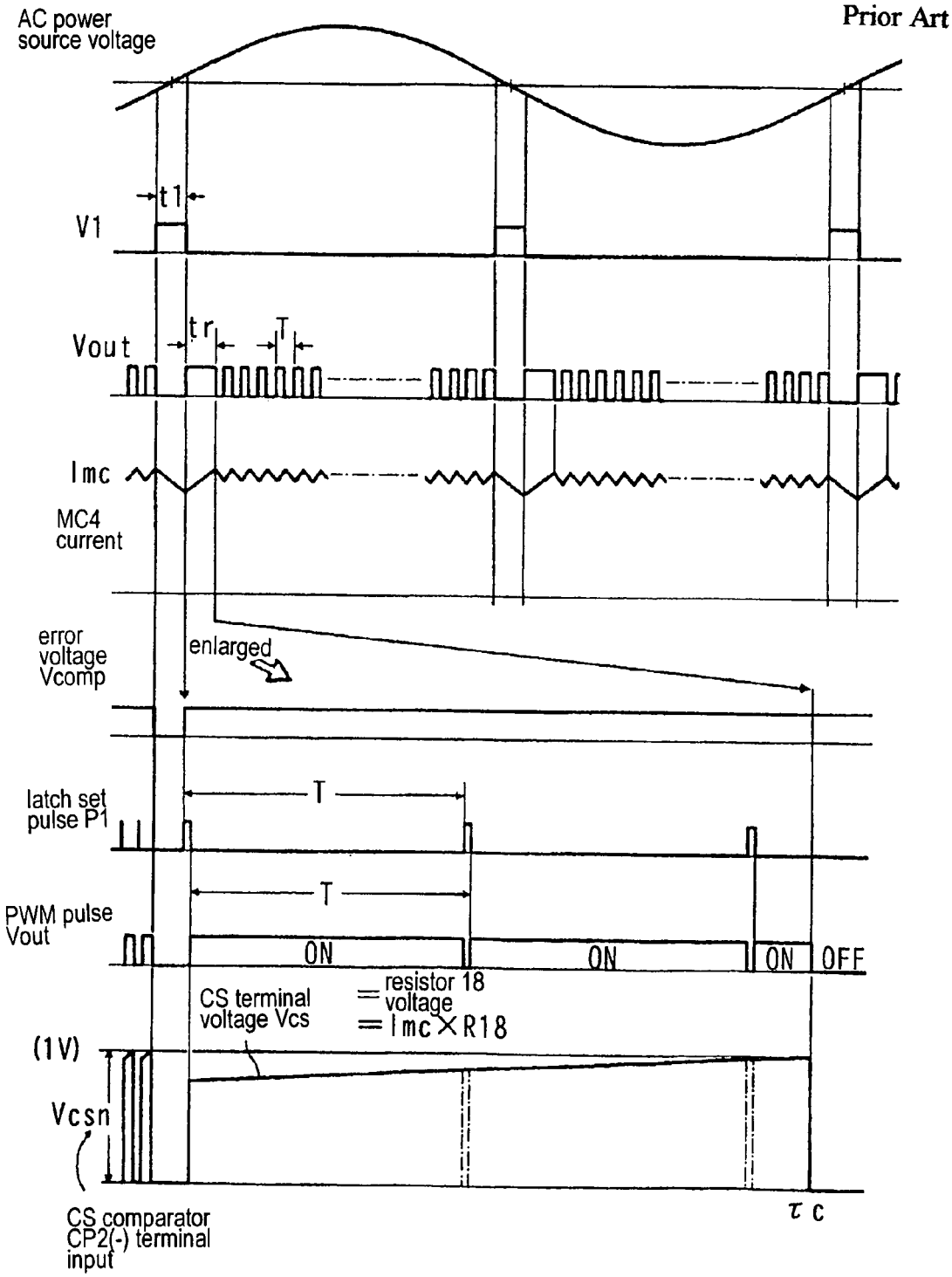
Fig. 9 Prior Art
FIG. 9 is a waveform diagram illustrating an operation of main components shown in FIG. 4.
Figure 10:
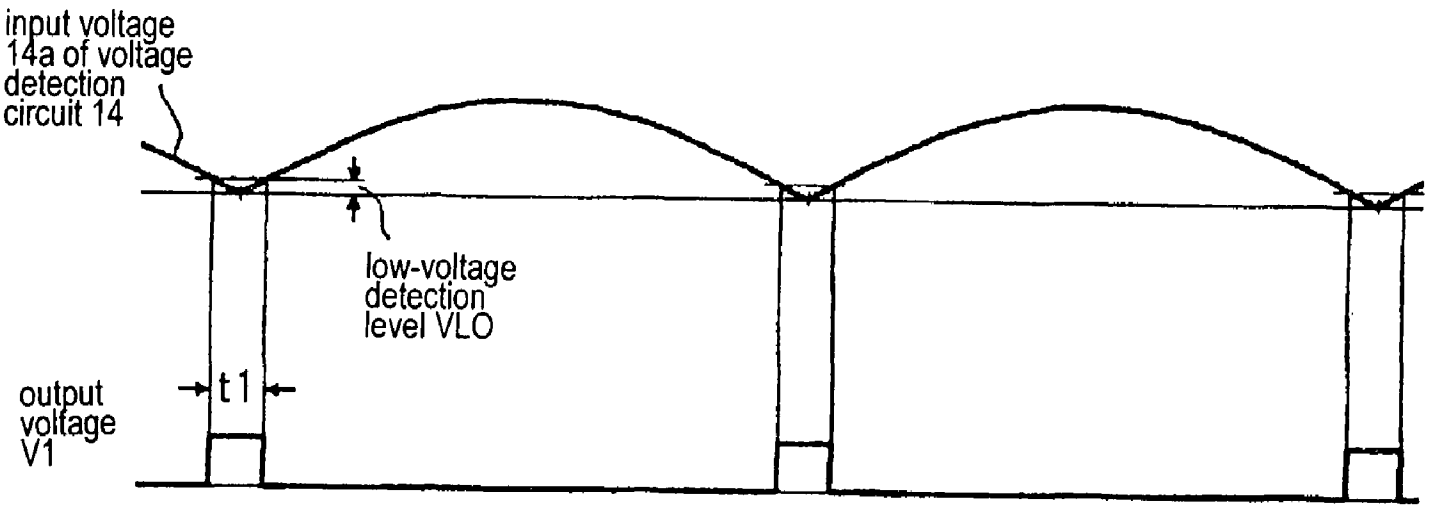
Fig. 10 Prior Art
FIG. 10 is a waveform diagram for explaining an operation of a voltage detection circuit 14 shown in FIGS. 1 to 4.

The interval t2 following the non-conductive interval t1 is selected to be larger than a substantially ON interval of a PWM pulse Vout in FIG. 9, that is, a continuous ON interval tr of a power MOSFET 17. The output voltage V2 of the mono-stable circuit 20 is divided by resistors 21 and 19 and a current detection resistor 18. As compared with the circuit diagram shown in FIG. 4, a divided voltage component of the resistors 19 and 18 created by the voltage V2 within the interval t2 is added to a voltage (CS terminal voltage) Vcs to be applied to the current detection terminal CS of the current mode PWM control IC 11. A value R18 of the current detection resistor 18 is substantially lower than that of the resistor 19, so that the divided voltage component becomes almost the voltage of the resistor 19.

Therefore, within the interval t2, the CS terminal voltage Vcs, as shown by a hidden line in FIG. 6, becomes a superposition of a voltage (Imc×R18) of the current detection resistor 18 created by a current Imc of the magnetizing coil 4 and a voltage of the resistor 19 composed of the divided voltage component of a mono-stable circuit output voltage V2, within the interval of the H level of the PWM pulse Vout, that is, the ON period of the power MOSFET 17.

In the embodiment, even within the interval t2, the CS terminal voltage Vcs composed of the superimposed voltage reaches an (−) input terminal voltage Vcsn (in the present example, 1 V) of a CS comparator CP2 located in the IC 11 per each output cycle T of the latch pulse P1. Accordingly, within the interval t2 following the non-conductive interval t1, the power MOSFET 17 repeats switching per each output cycle T of the latch pulse P1 and the current Imc of the magnetizing coil 4 increases to a set value, while repeating small pulsations. Therefore, the beat noise of the electromagnetic device is reduced.

[Second Embodiment]

Figure 2:
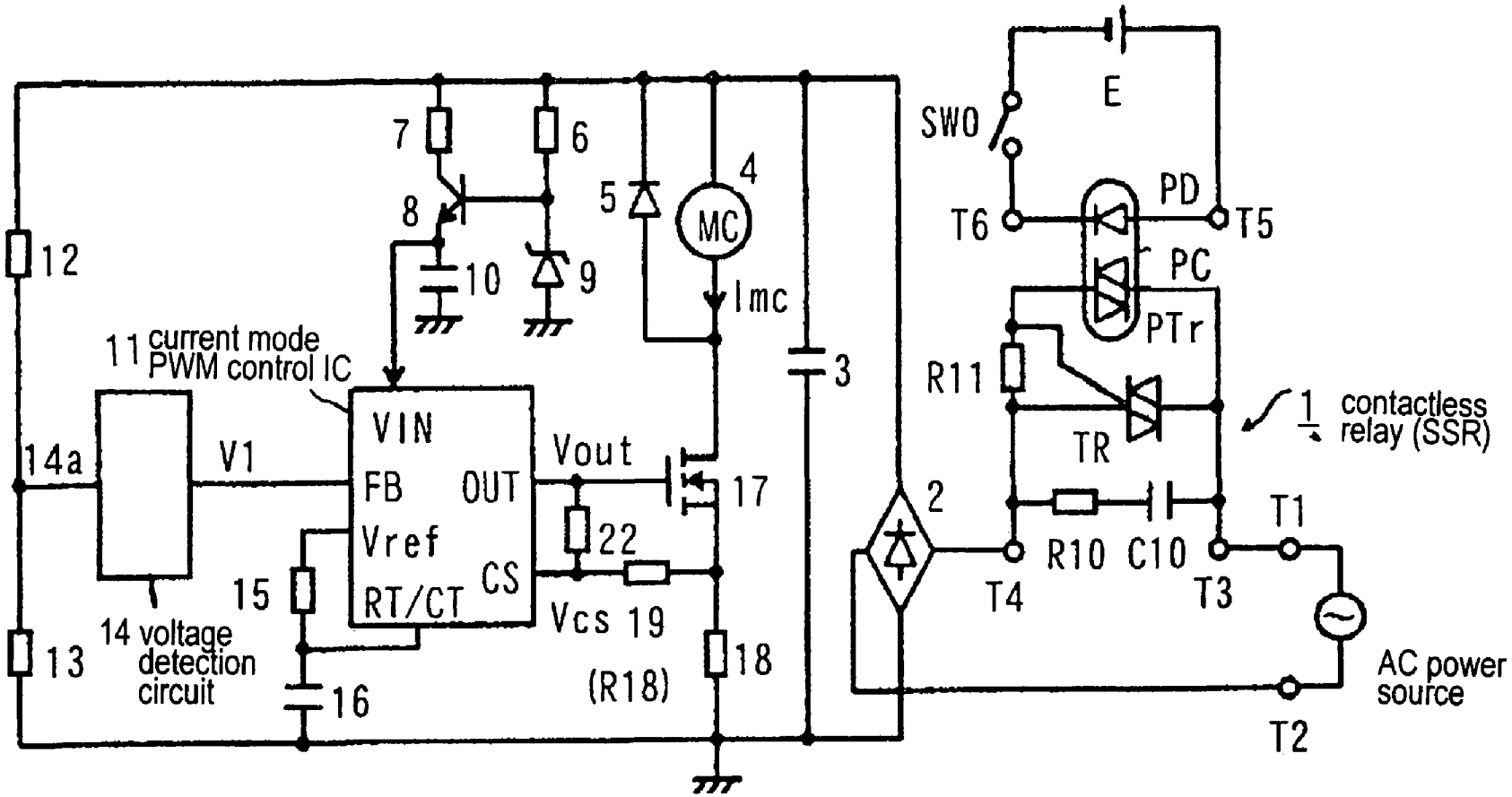
FIG. 2 is a circuit diagram illustrating a configuration according to a second embodiment of the present invention.
Figure 7:
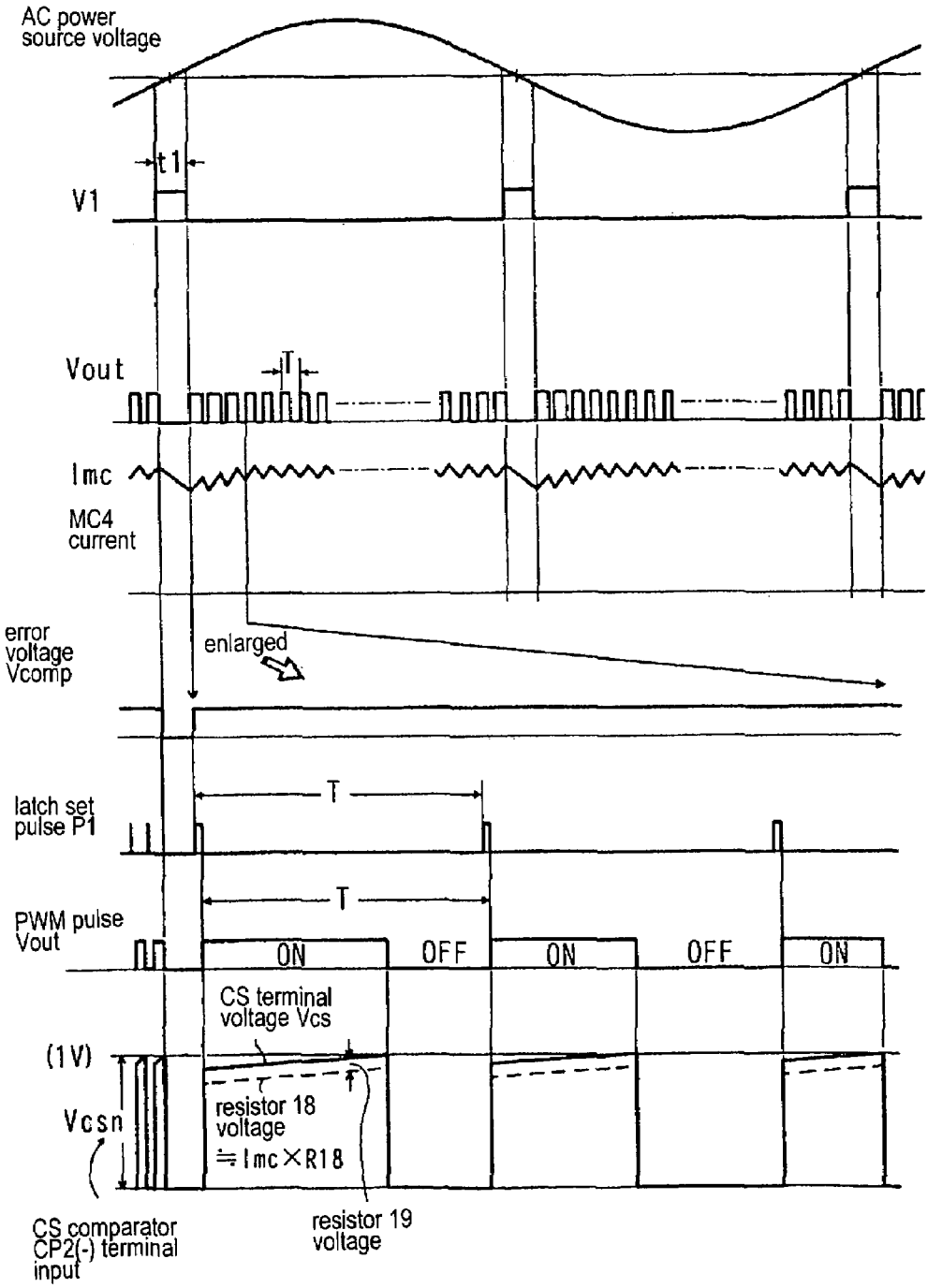
FIG. 7 is a waveform diagram illustrating an operation of main components shown in FIG. 2.

FIG. 2 shows a circuit diagram of a drive device for an electromagnetic device according to a second embodiment of the present invention. FIG. 7 shows an operational waveform of a main part of the circuit shown in FIG. 2 when the electromagnetic device becomes a hold state. Here, FIG. 2 corresponds to FIG. 4, and FIG. 7 corresponds to FIG. 9.

The circuit diagram shown in FIG. 2, in addition to the components shown in FIG. 4, comprises a resistor 22 connected between the PWM pulse output terminal OUT of the current mode PWM control IC 11 and the current detection terminal CS. In the circuit shown in FIG. 2, each time the PWM pulse Vout of the H level is outputted, the voltage of the PWM pulse Vout is divided by the resistors 22 and 19 and current detection resistor 18. Accordingly, in this case, the superimposed voltage of the divided voltage component of the PWM pulse Vout, i.e. the voltage applied to the resistor 19, and the voltage (Imc×R18) of the current detection resistor 18 created by the current Imc of the magnetizing coil 4 becomes the CS terminal voltage Vcs applied to the current detection terminal CS of the IC 11.

In the circuit diagram shown in FIG. 2, as shown in FIG. 7, within the interval following the non-conductive interval t1, the CS terminal voltage Vcs composed of the superimposed voltage reaches 1 V of the (−) input terminal voltage Vcsn of the CS comparator CP2 located in the IC 11 per each output cycle T of the latch pulse P1. The current Imc of the magnetizing coil increases to the set value, while repeating small pulsations.

[Third Embodiment]

Figure 3:
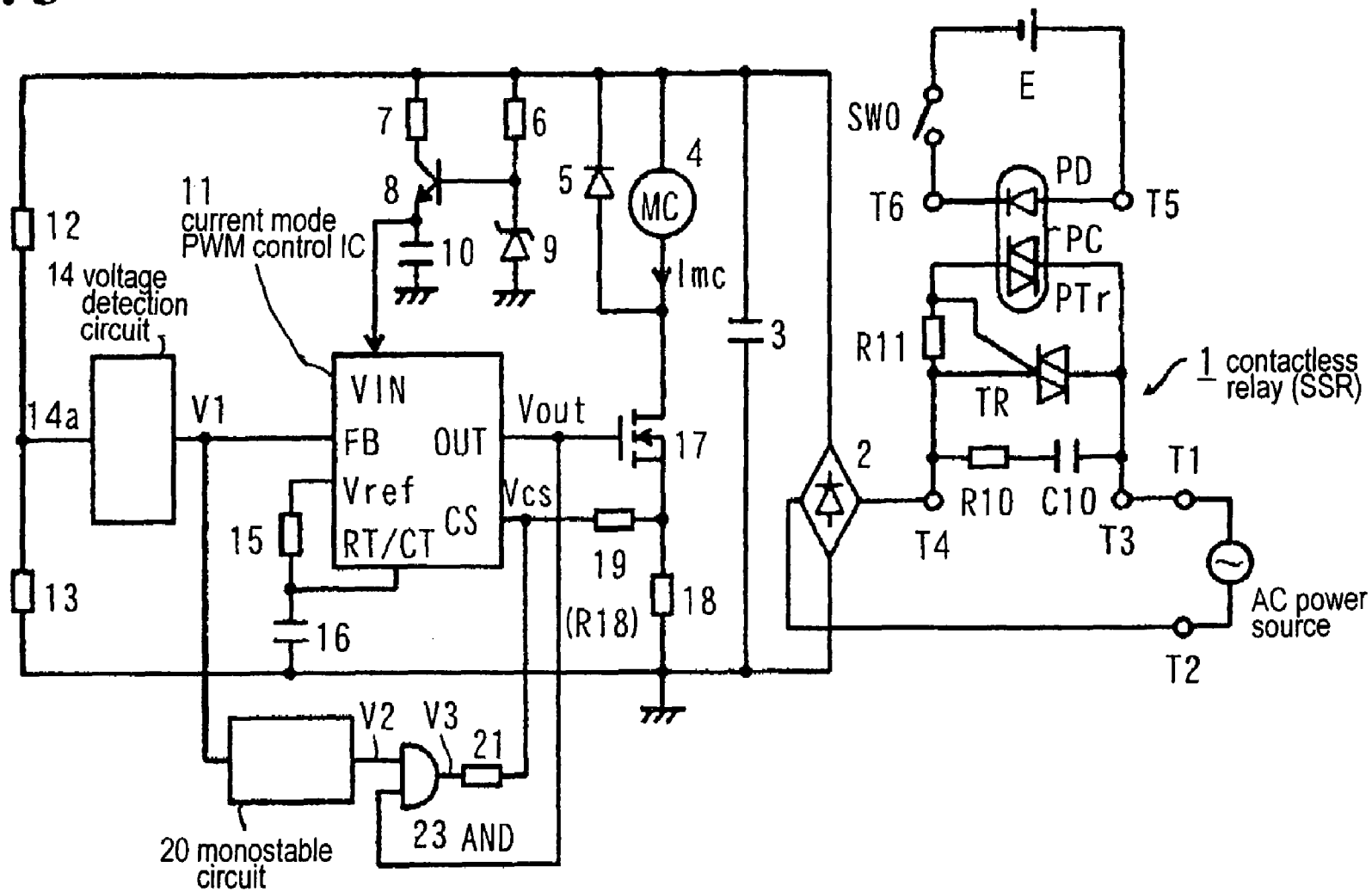
FIG. 3 is a circuit diagram illustrating a configuration according to a third embodiment of the present invention.
Figure 8:
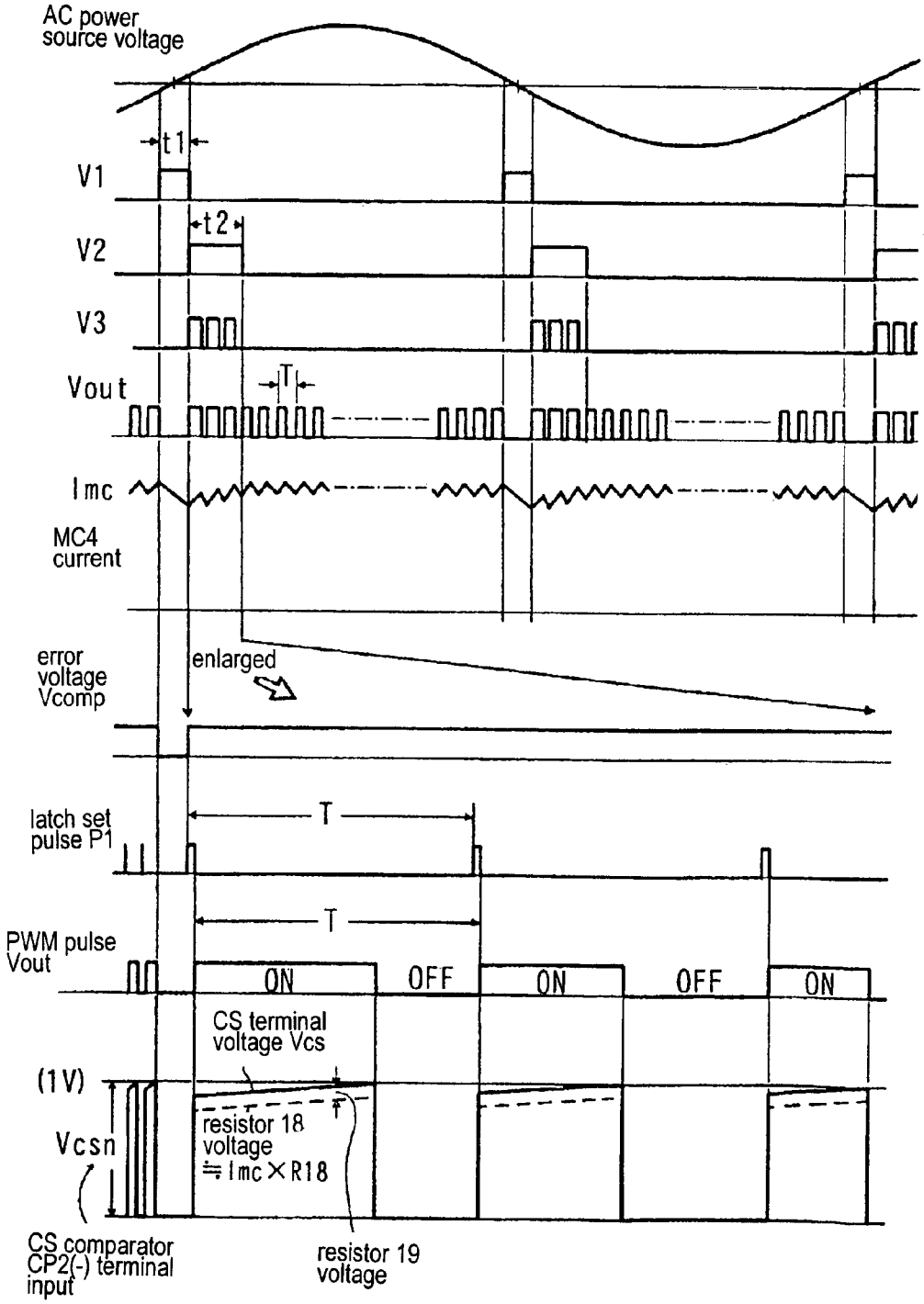
FIG. 8 is a waveform diagram illustrating an operation of main components shown in FIG. 3.

FIG. 3 shows a circuit diagram of a drive device for an electromagnetic device according to a third embodiment of the present invention. FIG. 8 shows an operational waveform of a main part of the circuit diagram shown in FIG. 3 when the electromagnetic device becomes a hold state. Here, FIG. 3 corresponds to FIG. 1, and FIG. 8 corresponds to FIG. 6.

In the circuit diagram shown in FIG. 3, in addition to the components shown in FIG. 1, an AND circuit 23 having one input terminal connected to the output of the mono-stable circuit 20 is inserted between the mono-stable circuit 20 and the resistor 21, and the other input terminal of the AND circuit 23 is connected to the PWM pulse output terminal OUT of the current mode PWM control IC 11. In the circuit diagram shown in FIG. 3, as shown in FIG. 8, within the interval t2 in which the output V2 of the mono-stable circuit 20 becomes the H level, the interval following the non-conductive interval t1, i.e. the output voltage V3 of the AND circuit 23, becomes the H level only when the PWM pulse Vout of the H level is outputted. The superimposed voltage of the divided voltage component of the resistor 19 created by the output voltage V3 and the voltage (Imc×R18) of the current detection resistor 18 created by the magnetizing coil current Imc becomes almost the CS terminal voltage Vcs.

Accordingly, as compared with the circuit diagram shown in FIG. 6, as shown in FIG. 8, an operation within the interval in which the PWM pulse Vout is at the H level and the power MOSFET 17 is ON, is similar to that shown in FIG. 6. The CS terminal voltage Vcs disappears within the interval in which the PWM pulse Vout is at the L level and the power MOSFET 17 is OFF. As a result, the power MOSFET 17 is thereby prevented from being erroneously switched ON by noise or the like within the interval in which the power MOSFET 17 is OFF.

Further, in the embodiments described above, the positive bias voltage as a voltage of the resistor 19 is superimposed on the voltage of the current detection resistor 18, that is, the detection voltage of the electric current of the magnetizing coil 4, within at least the predetermined interval following the non-conductive interval t1; A similar effect can be obtained by superimposing a negative bias voltage of the (−) input terminal voltage Vcsn of the CS comparator CP2 located in the IC 11, that is, the set value of the current in the magnetizing coil 4.

Further, the bias voltage may be a voltage with a waveform decreasing with time, for example, as the voltage of a capacitor discharged via a resistor serving as a load. Such an embodiment is also included in the present invention.

In the drive unit for the electromagnetic device, the non-conductive interval is provided in a region in the vicinity of zero of an AC power source voltage in order to reliably turn off the main switching element of the contact-less relay inserted between the AC power source and the magnetizing coil of the electromagnetic device controlled with the constant-current control by switching the switching means when the electromagnetic device needs to be released.

Conventionally, the switching means maintained the ON state within several switching cycles in the interval immediately after the non-conductive interval, so that the electric current of the magnetizing coil greatly attenuated from the set value in the non-conductive interval is rapidly returned to the set value. The switching means switches at the fixed switching cycle after the magnetizing coil current rapidly increases and reaches the set value, thereby generating beat noise in the electromagnetic device.

According to the present invention, the predetermined bias signal is superimposed on the current detection value or current set value at least within the predetermined interval following the non-conductive interval, the switching means is apparently switched to the off state after the magnetizing coil current reaches the set value within the predetermined switching cycle (composed of the fixed cycle) in which the switching means becomes the ON state. Accordingly, the switching means switches at the predetermined switching cycle immediately after the period of the non-conductive interval. Therefore, the magnetizing coil current does not increase rapidly immediately after the non-conductive interval without a complex control circuit, thereby reducing beat noise.

What is claimed is:

1. A drive unit for an electromagnetic device, comprising:

a switching control circuit for providing power to a magnetizing coil of the electromagnetic device with an intermittent pulse signal via switching means, wherein said switching control circuit switches the pulse signal so that the switching means which is in an off state is turned on at an initial timing in turn-on timings generated with a predetermined cycle, and the switching means which in an on state becomes the off state at a timing when a detected value of an electric current in the magnetizing coil becomes a predetermined current value, said drive unit closes and releases the electromagnetic device by switching a main switching element of a contact-less relay inserted between the magnetizing coil of the electromagnetic device and an AC power source, and said main switching element in the contact-less relay becomes a non-conductive state for a predetermined time interval longer than the predetermined cycle in a region in a vicinity of zero of a power source voltage below a self-holding current, wherein a predetermined bias signal is superimposed on the detected current value or the predetermined current value at least within a predetermined interval following the time interval of the non-conductive state, and said switching control circuit switches the pulse signal so that the switching means is switched in every predetermined cycle.

2. A drive unit for an electromagnetic device according to claim 1, wherein said bias signal is a continuous signal having a predetermined level.

3. A drive unit for an electromagnetic device according to claim 1, wherein said bias signal is a signal having a predetermined level which is present only when the switching means becomes the on state.

4. A drive unit for an electromagnetic device according to claim 3, wherein said bias signal is the pulse signal causing the switching means to become the on state.

5. A drive unit for an electromagnetic device according to claim 1, wherein said bias signal is a signal having a predetermined waveform with a level decreasing with time.

6. A drive unit for an electromagnetic device according to claim 1, wherein said switching means switches for a plurality of times in said predetermined interval following the time interval of the non-conductive state.

7. A drive unit for an electromagnetic device according to claim 6, wherein said switching control circuit includes means for providing said predetermined bias signal on said detected current value or the predetermined current value.

8. A drive unit for an electromagnetic device according to claim 7, wherein said means for providing said predetermined bias signal comprises a mono-stable circuit and a resister interposed between a voltage detection circuit and a current detection terminal of a current mode PWM control IC.

9. A drive unit for an electromagnetic device according to claim 7, wherein said means for providing said predetermined bias signal comprises a resistor connected between a PWM pulse output terminal of a current mode PWM control IC and a current detection terminal.

* * * * *